US007458245B1

(12) United States Patent
Wilcox

(10) Patent No.: US 7,458,245 B1
(45) Date of Patent: Dec. 2, 2008

(54) EXTREME OFFSET NOSE ASSEMBLY

(75) Inventor: Robert B. Wilcox, Woodstock, NY (US)

(73) Assignee: Huck International, Inc., Tucson, AZ (US)

( * ) Notice: Subject to any disclaimer, the term of this patent is extended or adjusted under 35 U.S.C. 154(b) by 0 days.

(21) Appl. No.: 12/099,741

(22) Filed: Apr. 8, 2008

(51) Int. Cl.
*B21J 15/20* (2006.01)

(52) U.S. Cl. ..... 72/391.8; 29/243.529

(58) Field of Classification Search ..... 72/391.2, 72/391.4, 391.8, 453.17; 29/243.521, 243.522, 29/243.529
See application file for complete search history.

(56) References Cited

U.S. PATENT DOCUMENTS 4,615,206 A * 10/1986 Rosier ..... 29/243.523
4,796,455 A * 1/1989 Rosier ..... 72/391.2
4,813,261 A * 3/1989 Rosier ..... 29/243.522
4,896,522 A * 1/1990 Rosier ..... 29/243.521
5,371,933 A * 12/1994 Godfrey ..... 29/243.529
6,739,170 B1 * 5/2004 Rosier ..... 72/391.8

* cited by examiner

*Primary Examiner*—David B Jones
(74) *Attorney, Agent, or Firm*—Greenberg Traurig LLP; Cynthia A. Dixon, Esq.

(57) ABSTRACT

An apparatus and method for utilizing an extreme offset nose assembly for installing fasteners are disclosed involving a drawbar, an anvil, and a collet. The drawbar having a first portion, a second portion, a third portion. The third portion transitioning from the second portion by a chamfer or a shoulder. The anvil having a cavity, a first aperture, and a second aperture. The collet having a first bore and a second bore. The drawbar having a section of the first portion disposed within the first aperture, a front section of the second portion threadedly engaged within the second bore of the collet, a rearward section of the second portion passing through the second aperture of the anvil thereby providing a bearing surface between the rearward section of the second portion and the second aperture of the anvil, and the third portion passing through the second aperture of the anvil.

20 Claims, 4 Drawing Sheets

EXTREME OFFSET NOSE ASSEMBLY

BACKGROUND OF THE DISCLOSURE

The present disclosure relates to fastener installation tools. In particular, it relates to fastener installation tools having extreme offset nose assemblies.

SUMMARY OF THE DISCLOSURE

The present disclosure relates to an apparatus and method utilizing an extreme offset nose assembly for installing fasteners. In one or more embodiments, the apparatus and method employing an extreme offset nose assembly involves a drawbar, an anvil, and a collet. The drawbar having a first diameter portion, a second diameter portion, a third diameter portion, and threads disposed at a rearward end of the drawbar. The first diameter portion having an enlarged bearing head and a diameter greater than the second diameter portion. The second diameter portion having a diameter at least equal to the third diameter portion and transitioning from the first diameter portion by a shoulder. The third diameter portion transitioning from the second diameter portion by a chamfer. The chamfer of a preselected angle having no contact with an end of a piston of a fastener installation tool.

In one or more embodiments, the anvil having a cavity, a first aperture, and a second aperture. The first aperture being adapted to receive a portion of the first diameter portion of the drawbar. In one or more embodiments, the collet having a first bore and a second bore. The first bore being adapted to receive a chuck jaw assembly for grippingly engaging fasteners. The second bore being adapted to receive the second diameter portion of the drawbar. The collet being slidably disposed within the anvil.

In one or more embodiments, the drawbar having a section of the first diameter portion disposed within the first aperture, a front section of the second diameter portion threadedly engaged within the second bore of the collet, a rearward section of the second diameter portion passing through the second aperture of the anvil thereby providing a bearing surface between the rearward section of the second diameter portion and the second aperture of the anvil, and the third diameter portion passing through the second aperture of the anvil.

In one or more embodiments, the front section of the second diameter portion of the drawbar includes left-hand threads. Also, the threads disposed at the rearward end of the drawbar are right-hand threads. In addition, the chuck jaw assembly is a unitized chuck jaw assembly. Also, the first diameter portion of the drawbar includes an internal hexagonal recess at the front end of the drawbar for receiving a hexagonal key.

In one or more embodiments, the apparatus is rotatable about the axis of the drawbar. Additionally, the apparatus is secured to the fastener installation tool in an upside down orientation relative to the fastener installation tool. Also, the apparatus further comprises threads disposed at a rearward end of the first bore, and a deflector attached to a nut that is threadedly engaged with the rearward end of the first bore.

In one or more embodiments, the apparatus further comprises a guard assembly attached to the collet, where the guard assembly covers an opening between the collet and the anvil. In one or more embodiments, the end of the piston of the fastener installation tool is a chamfer of a preselected angle. Alternatively, in one or more embodiments, the end of the piston of the fastener installation tool is a shoulder.

BRIEF DESCRIPTION OF THE DRAWINGS

These and other features, aspects, and advantages of the present disclosure will become better understood with regard to the following description, appended claims, and accompanying drawings where:

DETAILED DESCRIPTION

The apparatus and methods disclosed herein provide an operative system for installing fasteners. Specifically, this fastener installation system employs an extreme offset nose assembly.

Fastener installation tools having offset nose assemblies are used for installing multi-pieced fasteners within small clearance spaces. Examples of multi-piece fasteners include, but are not limited to, lockbolt fasteners and swage type fasteners. The offset nose assemblies allow the fastener installation tool to fit into a small clearance space and to effectively install a fastener by gripping the pin and swaging the fastener collar. Typically, after the fastener has been installed, the offset nose assemblies sever the pintail and eject it through the back end of the tool. In very limited clearance spaces, prior nose assemblies have been unable to position and manipulate the fasteners adequately within the confined and/or obstructed application areas.

The extreme offset nose assembly of the present disclosure is able to effectively install fasteners in very limited clearance spaces, including J-channels in airplane wings and body sections. Prior offset nose assemblies are not able to effectively install fasteners in very limited clearance spaces, such as in J-channels, because they are unable to adjust for the position of the collet relative to the anvil. This unadjustability of the prior offset nose assemblies can cause the swaged fastener to not be fully ejected off and/or cause lack of usable stroke in critical clearance applications. Lack of usable stroke can necessitate "double driving" a fastener, which means that two attempts are required to install the fastener. "Double driving" a fastener can cause damage to both the fastener and the installation tool and, thus, should be avoided.

Prior offset nose assemblies do not provide enough offset distance from the pulling axis of the hydraulic tool to the fastener installation pulling axis. The mechanical designs of these prior offset nose assemblies cause them to lack stiffness and structural integrity to properly install a fastener at such a large offset distance from the fastener installation pulling axis to the hydraulic tool.

In the following description, numerous details are set forth in order to provide a more thorough description of the system. It will be apparent, however, to one skilled in the art, that the disclosed system may be practiced without these specific details. In the other instances, well known features have not been described in detail so as not to unnecessarily obscure the system.

Figure 1:
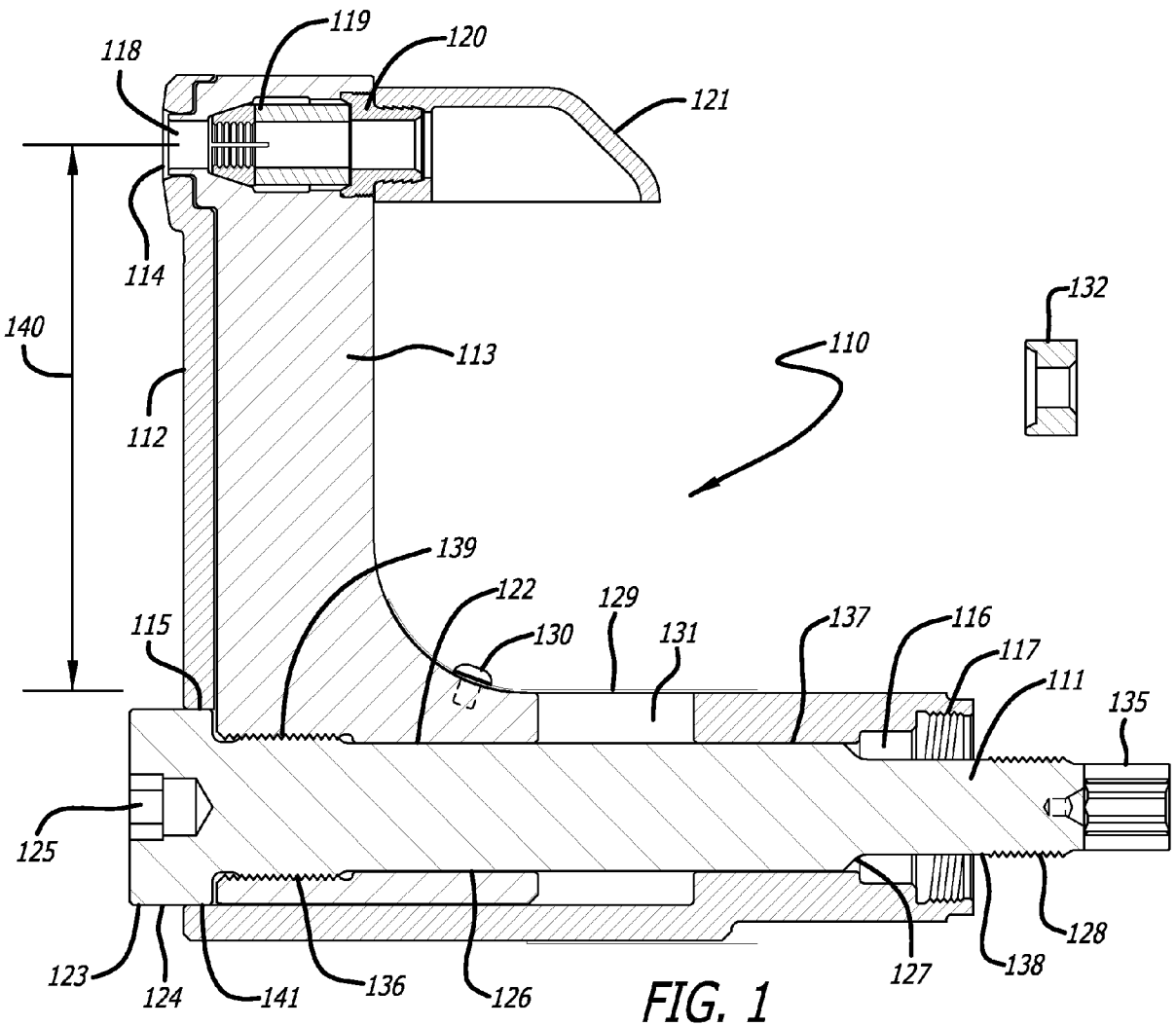
FIG. 1 is a vertical cross-sectional view of the extreme offset nose assembly in accordance with one embodiment of the present disclosure.

FIG. 1 contains a vertical cross-sectional view of the extreme offset nose assembly 110 in accordance with one or more embodiments of the present disclosure. In this figure, the extreme offset nose assembly 110 of the present disclosure is shown as having a large offset distance 140. The extreme offset nose assembly 110 includes a drawbar 111, a collet 113, and an anvil 112. The drawbar 111 has a first portion 123, a second portion 126, and a third portion 138. The first portion 123 of the drawbar 111 comprises an enlarged bearing head 124. The enlarged bearing head 124 of the drawbar 111 includes an internal hexagonal recess 125 located at the front end of the drawbar 111 to receive a hexagonal key.

In one or more embodiments, the first portion 123 of the drawbar 111 transitions with a shoulder to the second portion 126 of the drawbar 111. The second portion 126 of the drawbar 111 has a reduced diameter than the first portion 123 of the drawbar 111. A section of the second portion 126 of the drawbar 111 that is adjacent to the transitional shoulder of the first portion 123 of the drawbar 111 contains left-hand threads 136.

In one or more embodiments, the third portion 138 of the drawbar 111 has an equal diameter to the second portion 126 of the drawbar 111, or a reduced diameter than the second portion 126 of the drawbar 111. If the third portion 138 of the drawbar 111 has a reduced diameter than the second portion 126 of the drawbar, the second portion 126 of the drawbar 111 transitions to a third portion 138 of the drawbar 111 with a chamfer 127 or a shoulder (not shown). In one or more embodiments, the chamfer 127 of the drawbar 111 is of an angle between 5 degrees to 90 degrees (5°-90°). In one or more embodiments, the shoulder (not shown) of the drawbar 111 may have a radiused corner.

The third portion 138 of the drawbar 111 includes a lock screw 135 located at the rearward end of the drawbar 111. In addition, a section of the third portion 138 of the drawbar 111 that is adjacent to the rearward end of the drawbar 111 includes right-hand threads 128.

In one or more embodiments, the collet 113 of the extreme offset nose assembly 110 comprises a first bore 118 and a second bore 122. The first bore 118 of the collet 113 receives a chuck jaw assembly 119. In one or more embodiments, the type of chuck jaw assembly 119 employed is a unitized chuck jaw assembly. The chuck jaw assembly 119 is adapted to grasp the pintail portion of a fastener during installation of the fastener. A section of the first bore 118 of the collet 113 that is located towards the rearward end of the collet 113 includes right-hand threads that are adapted to receive the right-hand threads of a retaining nut 120. Conversely, in one or more embodiments, the threads of the first bore 118 of the collet 113 may be left-hand threads instead of right-hand threads in order to receive the left-hand threads of a retaining nut 120. The retaining nut 120 is threadedly engaged with the threads of the first bore 118 such that the retaining nut 120 is seated flush with the outer surface of the first bore 118 of the collet 113.

The retaining nut 120 of the first bore 118 of the collet 113 has a deflector 121 attached to it. In one or more embodiments, the deflector 121 may be attached to the nut by methods including, but not limited to, thermal adhesion, glue, screws, and clamps. The deflector 121 acts as a shield to protect the operator of the extreme offset nose assembly 110 from severed fastener pintails as they are ejected off.

In one or more embodiments, the second bore 122 of the collet 113 is adapted to receive the second portion 126 of the drawbar 111. A section of the second bore 122 of the collet 113 that is adjacent to the enlarged bearing head 124 of the drawbar 111 includes left-hand threads 139 that are adapted to receive the left-hand threads 136 of the second portion 126 of the drawbar 111. During operation of the extreme offset nose assembly 110, the threads 139 of the second bore 122 of the collet 113 are threadedly engaged with the threads 136 of the second portion 126 of the drawbar 111. In addition, the enlarged bearing head 124 of the drawbar 111 is of a larger diameter than the second bore 122 of the collet 113. The shoulder of the enlarged bearing head 124 has no contact with the exterior surface adjacent to the second bore 122 of the collet 113. However, a section of the exterior of the enlarge bearing head 124 of the drawbar 111 is in engaged with the interior surface of the first aperture 115 of the anvil 112, thereby providing a bearing surface 141.

In one or more embodiments, the anvil 112 of the extreme offset nose assembly 110 includes a cavity 114, a first aperture 115, and a second aperture 116. Various types of anvils, including swage anvils, may be employed for the anvil 112. When a swage anvil is utilized for the anvil 112, the cavity 114 of the anvil 112 is adapted to swage a collar into the grooves of a fastener pin when the offset nose assembly 110 is actuated to install a fastener. Alternatively, in one or more embodiments, an anvil with a bore to clear a fastener may be employed for the anvil 112. When this type of anvil is used for the anvil 112, the extreme offset nose assembly can pull a fastener into an interference fit hole in a structure.

In one or more embodiments, the first aperture 115 of the anvil 112 receives the first portion 123 of the drawbar 111, which comprises the enlarged bearing head 124 of the drawbar 111. And, the second aperture 116 of the anvil 112 receives the second portion 126 and third portion 138 of the drawbar 111. The section of the second aperture 116 of the anvil 112 that receives the second portion 126 of the drawbar provides a bearing surface 137. In addition, a section of the second aperture 116 that is adjacent to the rearward end of the anvil 112 includes threads 117.

In one or more embodiments, a guard assembly 129 is attached to the exterior surface of the collet 113. The guard assembly 129 may be attached to the collet 113 by various methods. Methods for attaching the guard assembly 129 to the collet 113 include, but are not limited to, thermal adhesion, glue, screws, and clamps. In FIG. 1, the guard assembly 129 is depicted as being attached to the exterior of the collet 113 by a screw 130. The guard assembly 129 is situated on the exterior of the collet 113 and of a sufficient length such that it covers the opening 131 between the collet 113 and the anvil 112. The guard assembly 129 is employed to protect the operator's fingers, during actuation of the extreme offset nose assembly 110, from the pinch points located inside the opening 131 between collet 113 and the anvil 112.

Figure 2:
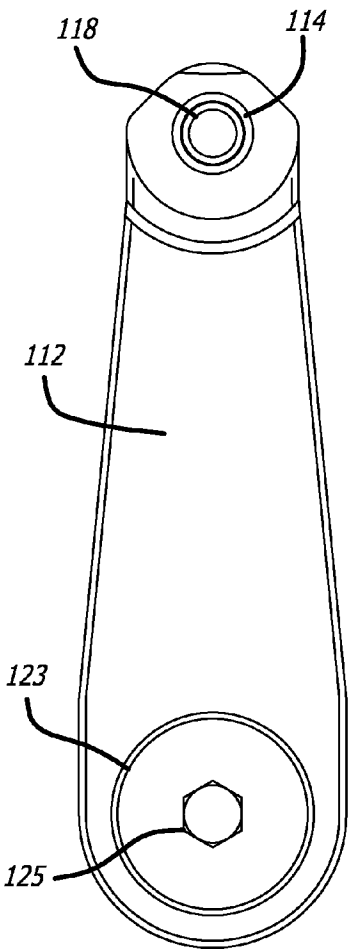
FIG. 2 is an end view of the extreme offset nose assembly in accordance with at least the embodiment illustrated in FIG. 1.

FIG. 2 illustrates the end view of the extreme offset nose assembly in accordance with at least the embodiment illustrated in FIG. 1. In this Figure, the exterior of the front end of the anvil 112 is shown. Also in this view, the enlarged bearing head 124 of the first portion 123 of the drawbar 111 with its internal hexagonal recess 125 can be seen. In addition, this view shows the cavity 114 of the anvil 112 as well as the first bore 118 of the collet 113.

Figure 3:
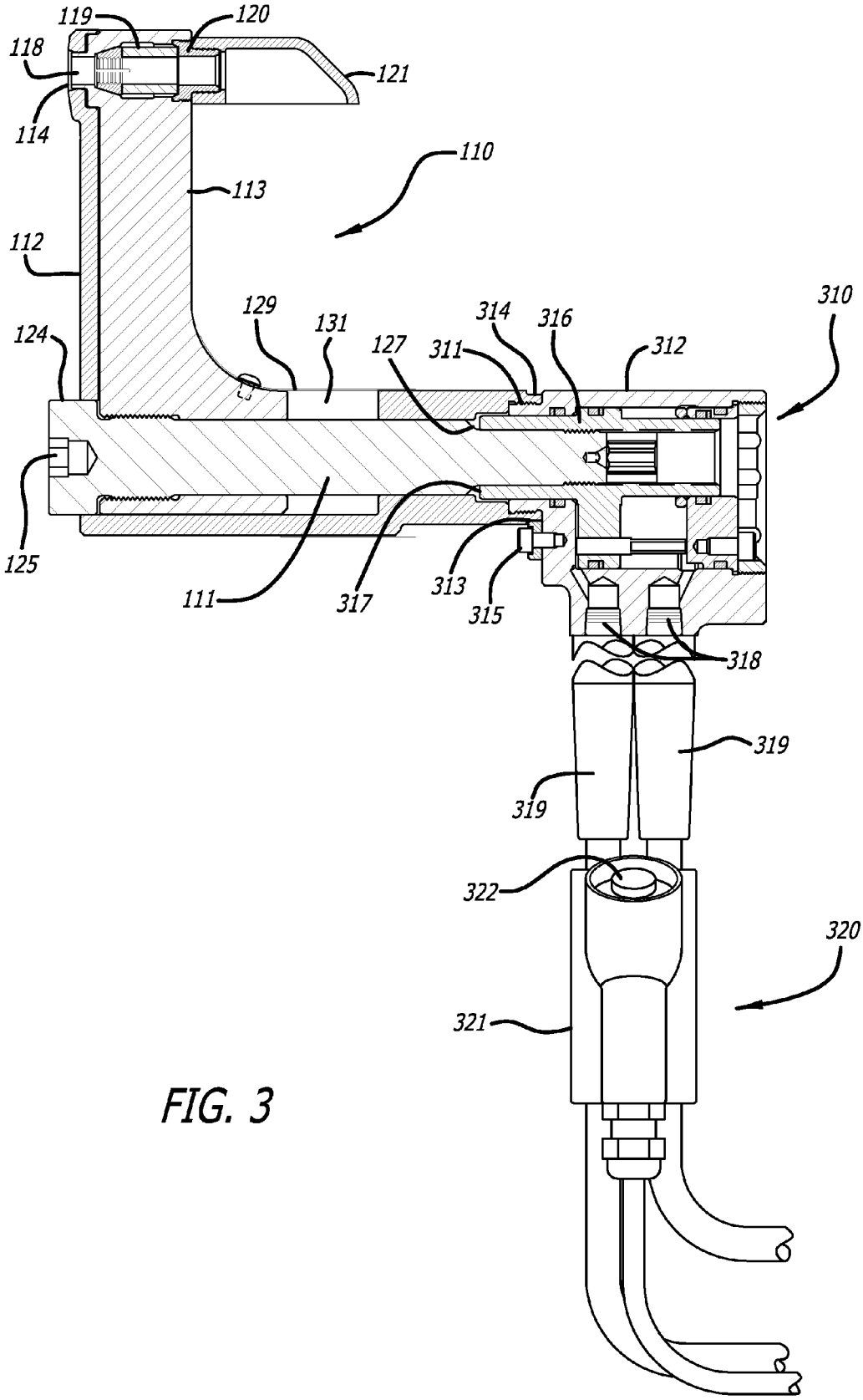
FIG. 3 is a vertical cross-sectional view of the extreme offset nose assembly connected with a hydraulic tool in accordance with one embodiment of the present disclosure.

FIG. 3 contains a vertical cross-sectional view of the extreme offset nose assembly 110 connected with a hydraulic tool 310 in accordance with one or more embodiments of the present disclosure. In this figure, a hydraulic fastener installation tool 310 is connected to the extreme offset nose assembly 110. The hydraulic fastener installation tool 310 may be attached to the extreme offset nose assembly 110 in either a right-side up orientation or an upside down orientation. The right-side up orientation is depicted in FIG. 3. During operation of the fastener installation tool 310, a screw 315 is disposed in either a bottom groove 313 of the anvil 112 for the right-side up orientation, or an upper groove 314 of the anvil 112 for the upside down orientation. The screw 315, when disposed in either the bottom groove 313 or the upper groove 314, is threadedly engaged with the housing 312 of the fastener installation tool 310. When a screw 315 is disposed in the bottom groove 313 of the anvil 112, 120 degrees (120°) of rotatable movement of the offset nose assembly 110 relative to the axis of the drawbar 111 is permitted. Conversely, when a screw 315 is disposed in the upper groove 314, the screw 315 acts as a stop to the extreme offset nose assembly 110, and does not permit rotation of the offset nose assembly 110 relative to the axis of the drawbar 111.

In one or more embodiments, threads 117 that are located on a section of the second aperture 116 of the anvil 112 are threadedly engaged 311 with the housing 312 of the fastener installation tool 310. In addition, the internal hexagonal recess 125 of the enlarged bearing head 124 of the drawbar 111 receives a hexagonal key that is used to assist in the threaded engagement of the drawbar 111 to a piston 316 of the fastener installation tool 310. As the hexagonal key is turned, the drawbar 111 becomes threadedly engaged with the piston 316 of the fastener installation tool 310.

In one or more embodiments, the chamfer 127 of the drawbar 111 is of a preselected angle. The chamfer 127 of the drawbar has no contact with the end 317 of the piston 316 of the fastener installation tool 310. In one or more embodiments, the end 317 of the piston 316 of the fastener installation tool 310 is a shoulder. The shoulder may be formed with a radiused corner. Alternatively, in one or more embodiments, the end 317 of the piston 316 of the fastener installation tool 310 is a chamfer (not shown). The chamfer is of an angle between 5 degrees to 90 degrees (5°-90°). In one or more embodiments, the right-hand threads 128, which are located on a section of the third portion 138 of the drawbar 111 that is adjacent to the rearward end of the drawbar, are threadedly engaged with the right-hand threads of the piston 316.

In one or more embodiments, a hydraulic pressure source is connected to the fastener installation tool 310. The hydraulic hoses 319 of the hydraulic pressure source are attached to the hydraulic ports 318 of the fastener installation tool 310. The hydraulic pressure source includes a control unit 321, which includes a switch 322. When the operator activates the switch 322 on the control unit 321 of the hydraulic pressure source, the supply and removal of hydraulic fluid through the hydraulic ports 318 to the fastener installation tool 310 is actuated. The control unit 321 of the hydraulic pressure source may be activated by various energies including, but not limited to, electrical current and pneumatic energy.

The remaining components of the fastener installation tool 310 as well as the hydraulic pressure source are well known in the art. As such, the description of these remaining elements has been omitted for simplicity and so as to not obscure the disclosed system. The extreme offset nose assembly 110 of the present disclosure has been illustrated and described for the installation of lockbolt and swage type fasteners, which are both multi-piece type fasteners comprising a pin and collar. However, features of the extreme offset nose assembly 110 of the present disclosure may be utilized for the installation of blind fasteners, which are multi-piece fasteners comprising a pin and a sleeve, or other types of non-swage type fasteners including fasteners without collars that are pulled into interference fit holes.

Figure 4:
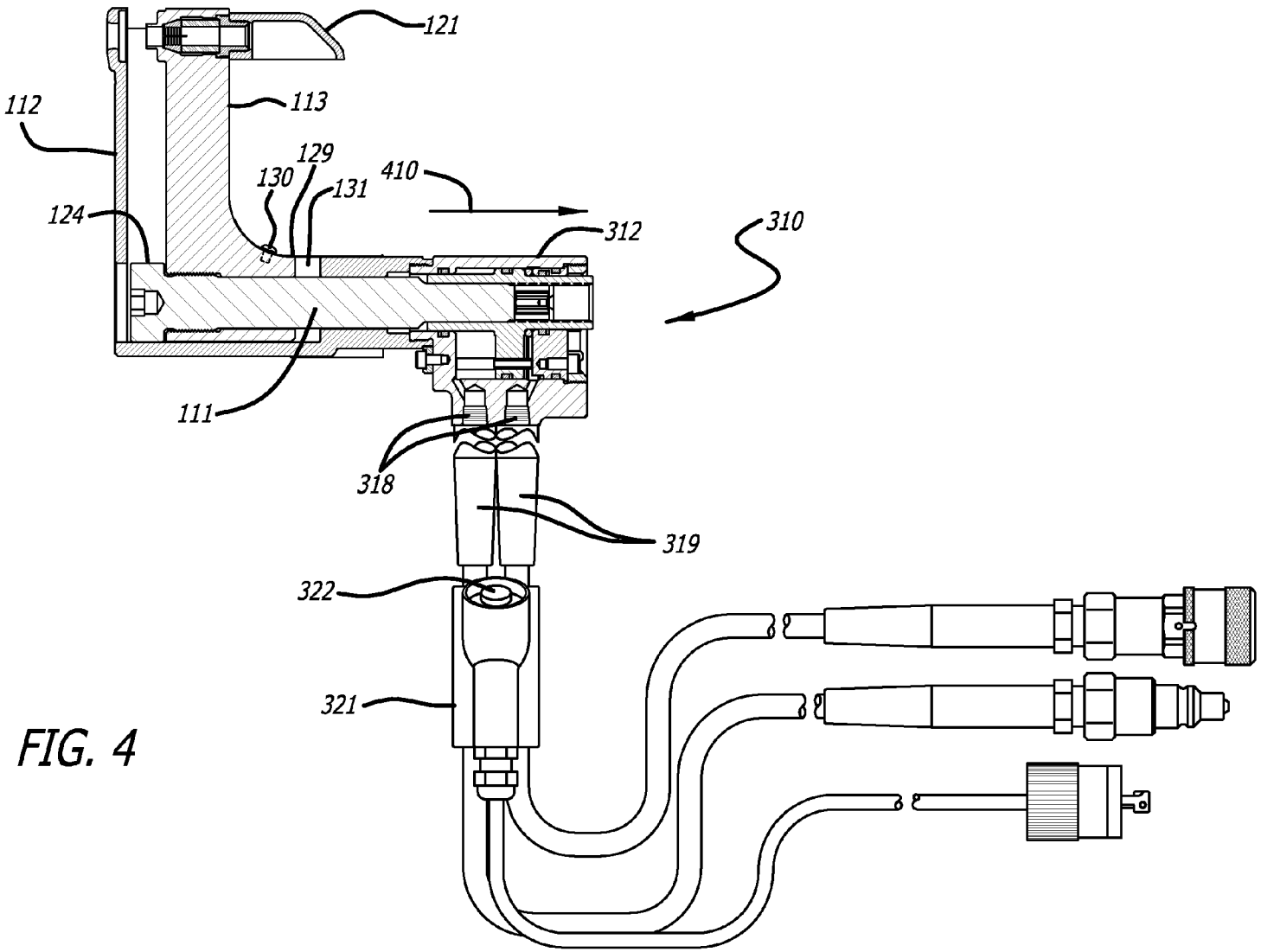
FIG. 4 is a vertical cross-sectional view of the extreme offset nose assembly in a stroked position connected with a hydraulic tool in accordance with at least the embodiment illustrated in FIG. 3.

The method for utilizing the extreme offset nose assembly 110 for the installation of fasteners, for one or more embodiments, is as follows. When the fastener installation tool 310 is in a deactivated state, meaning that there is no hydraulic pressure being applied to the tool 310, the chuck jaws of the chuck jaw assembly 119 are radially separated and in a static opened state. When the chuck jaws are in this opened state, the shank of the pin of the of the fastener is inserted through the cavity 114 of the anvil 112 into the opening of the chuck jaws. Once the pin is inserted inside of the chuck jaws, the operator will activate the hydraulic pressure source by depressing the switch 322 on the control unit 321. Once the hydraulic pressure source is activated, the hydraulic pressure being applied to the fastener installation tool 310 will cause the piston 316 and the drawbar 111 to actuate rearwardly along the pull stroke of the fastener installation tool 310. FIG. 4 depicts the fastener installation tool 310 in a stroked position. The motion 410 of the pull stroke, which along the axis of the drawbar 111, is also indicated in FIG. 4.

When the drawbar 111 is moved rearwardly along the pull stroke 410, the bearing surface 137 in conjunction with the bearing surface 141 eliminate the bending load from being transferred to the piston 316 of the fastener installation tool 310. Rather, the bending load is transferred to the bearing surfaces 141 and 137. Therefore, during operation of the fastener installation tool 310, the piston 316 only receives axial load, not bending load, from the extreme offset nose assembly 110. Since the fastener installation tool 310 does not receive the bending load, the dual bearing surfaces 137, 141 allow for the extreme offset nose assembly 110 to have a large offset distance 140, which makes installing fasteners in limited clearance applications possible. Additionally, the dual bearing arrangement 137, 141 also helps to increase the extreme offset nose assembly 110 stiffness and to reduce deflection.

In one or more embodiments, the threaded engagement of the left-hand threads 136 of the second portion 126 of the drawbar allows for dead-forward, full stroke adjustment of the collet 113 relative to the anvil 112 at a large offset distance 140 by compensating for all of the manufacturing tolerances that are stacked up along the pulling axis. The dual threaded engagement arrangement 136, 128 of the present disclosure is able to compensate for the manufacturing tolerances because the threads located at both ends of the drawbar provide for large surface area and shear area, which helps to eliminate peening and damage to the collet 113 and to the drawbar 111 from the high contact stresses. In addition, the combination of left-hand threads 136 on the second portion 126 of the drawbar 111 and the right-hand threads 128 on the third portion 138 of the drawbar 111 creates a "fast-adjust" situation, meaning that very little rotation is required to yield a large axial movement of the collet 113 relative to the anvil 112 due to the additive nature of the opposite thread pitches turning simultaneously.

When the collet 113 is being moved to the stroked position, the chuck jaw assembly 119 is also being moved to the stroked position. As the chuck jaw assembly 119 is being moved to the stroked position, the chuck jaws of the chuck jaw assembly 119 move radially inward to a closed position. As the chuck jaws move radially inward to their closed position, the teeth of the chuck jaws clamp down and grip the similarly shaped grooves on the pull portion of the shank of the pin. As the chuck jaw assembly 119 is being moved to the stroked position, the cavity 114 of the anvil 112 is engaged with the fastener collar that is located over the shank of the pin. When a swage anvil is employed for the anvil 112, further movement of the collet 113 and the chuck jaw assembly 119 relative to the cavity 114 of the anvil 112 will result in the application of a sufficient amount of relative axial force to swage the collar onto the lock grooves on the shank of the pin. Upon application of additional relative axial force, the pintail will be severed at a weakened portion of the pin or at a breakneck groove.

Figure 5:
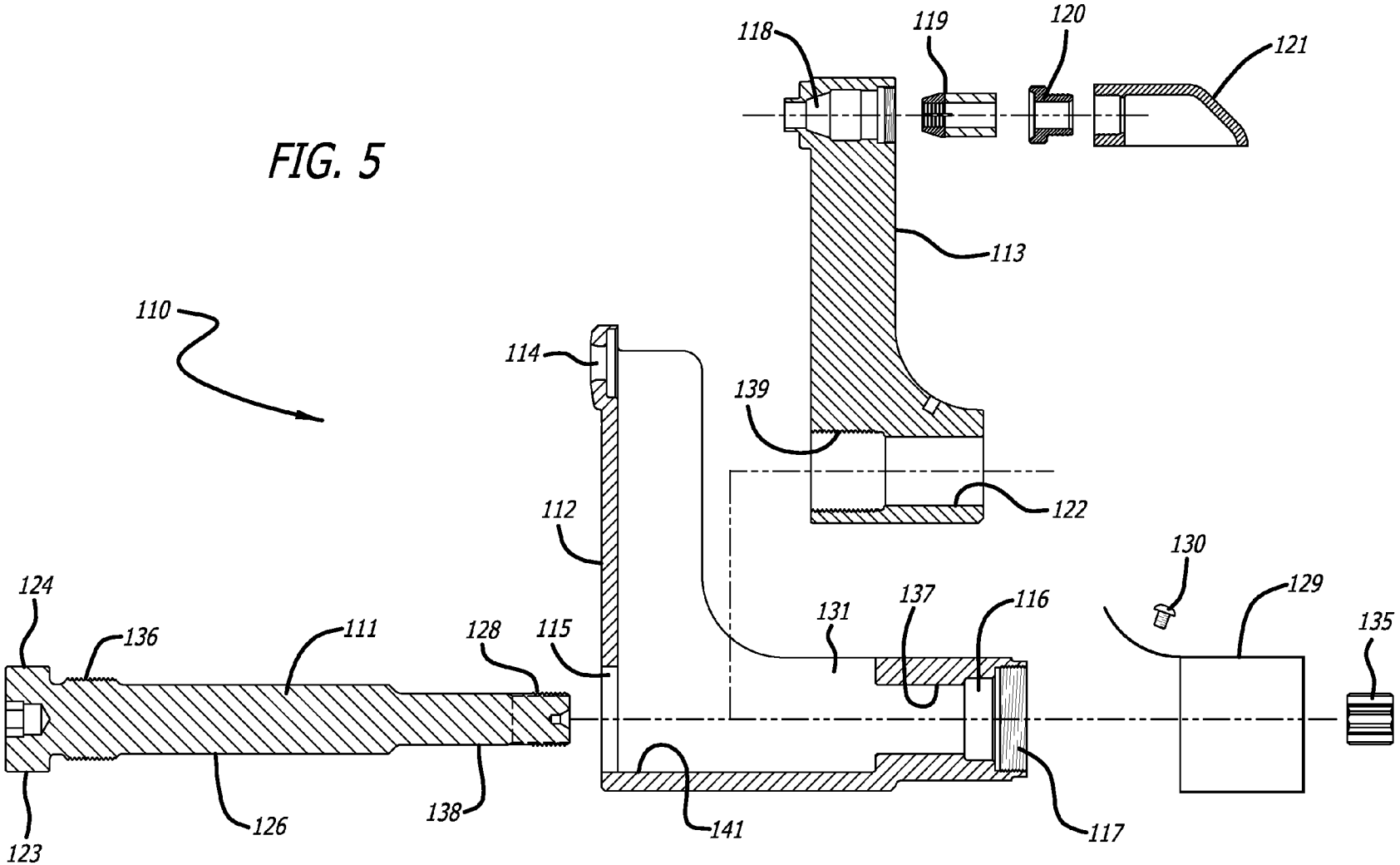
FIG. 5 is a vertical cross-sectional exploded view of the extreme offset nose assembly in accordance with at least the embodiment illustrated in FIG. 1.

Upon fracture of the shank of the pin, the resultant shock load will cause the chuck jaw assembly 119 to move axially rearwardly. As the chuck jaw assembly 119 moves axially rearwardly, the chuck jaws will open radially to their open state. When the chuck jaws are opened, the severed portion of the shank of the pin will be released by the chuck jaws. The severed portion of the pin will then pass through the first bore 118 of the collet 113 and be ejected out of the rearward end. The ejection of the severed portion of the pin member is safely controlled by the deflector 121. In addition, in one or more embodiments, FIG. 5 illustrates a vertical cross-sectional exploded view of the extreme offset nose assembly 110 in accordance with at least the embodiment illustrated in FIG. 1.

Alternatively, in one or more embodiments, when the extreme offset nose assembly 110 is being used in very limited clearance applications where the deflector 121 is too large to be able to adequately fit in the confined area, and when the operator will not be exposed to the ejected fastener pintail, a cap 132 is to be used in place of the deflector 121. Similar to the deflector, the cap 132 may be attached to the retaining nut 120 by methods including, but not limited to, threads, thermal adhesion, glue, screws, and clamps.

Although certain illustrative embodiments and methods have been disclosed herein, it can be apparent from the foregoing disclosure to those skilled in the art that variations and modifications of such embodiments and methods can be made without departing from the true spirit and scope of the art disclosed. Many other examples of the art disclosed exist, each differing from others in matters of detail only. Accordingly, it is intended that the art disclosed shall be limited only to the extent required by the appended claims and the rules and principles of applicable law.

I claim:

1. An apparatus for installing fasteners comprising:

a drawbar having a first diameter portion, a second diameter portion, a third diameter portion, and threads disposed at a rearward end of the drawbar, the first diameter portion having an enlarged bearing head and a diameter greater than the second diameter portion, the second diameter portion having a diameter at least equal to the third diameter portion and transitioning from the first diameter portion by a shoulder, the third diameter portion transitioning from the second diameter portion by a chamfer, the chamfer of a preselected angle having no contact with an end of a piston of a fastener installation tool;

an anvil having a cavity, a first aperture, and a second aperture, the first aperture being adapted to receive a portion of the first diameter portion of the drawbar;

a collet having a first bore and a second bore, the first bore being adapted to receive a chuck jaw assembly for grippingly engaging fasteners, the second bore being adapted to receive the second diameter portion of the drawbar, the collet being slidably disposed within the anvil; and the drawbar having a section of the first diameter portion disposed within the first aperture, a front section of the second diameter portion threadedly engaged within the second bore of the collet, a rearward section of the second diameter portion passing through the second aperture of the anvil thereby providing a bearing surface between the rearward section of the second diameter portion and the second aperture of the anvil, and the third diameter portion passing through the second aperture of the anvil.

2. The apparatus of claim 1, wherein the front section of the second diameter portion of the drawbar includes left-hand threads.

3. The apparatus of claim 1, wherein the threads disposed at the rearward end of the drawbar are right-hand threads.

4. The apparatus of claim 1, wherein the chuck jaw assembly is a unitized chuck jaw assembly.

5. The apparatus of claim 1, wherein the first diameter portion of the drawbar includes an internal hexagonal recess at the front end of the drawbar for receiving a hexagonal key.

6. The apparatus of claim 1, wherein the apparatus is rotatable about the axis of the drawbar.

7. The apparatus of claim 1, wherein the apparatus is secured to the fastener installation tool in an upside down orientation relative to the fastener installation tool.

8. The apparatus of claim 1, further comprising threads disposed at a rearward end of the first bore, and a deflector attached to a nut that is threadedly engaged with the rearward end of the first bore.

9. The apparatus of claim 1, further comprising a guard assembly attached to the collet, wherein the guard assembly covers an opening between the collet and the anvil.

10. The apparatus of claim 1, wherein the end of the piston of the fastener installation tool is a chamfer of a preselected angle.

11. The apparatus of claim 1, wherein the end of the piston of the fastener installation tool is a shoulder.

12. An apparatus for installing fasteners comprising:

a drawbar having a first diameter portion, a second diameter portion, a third diameter portion, and threads disposed at a rearward end of the drawbar, the first diameter portion having an enlarged bearing head and a diameter greater than the second diameter portion, the second diameter portion having a diameter at least equal to the third diameter portion and transitioning from the first diameter portion by a shoulder, the third diameter portion transitioning from the second diameter portion by a shoulder, the shoulder having no contact with an end of a piston of a fastener installation tool;

an anvil having a cavity, a first aperture, and a second aperture, the first aperture being adapted to receive a portion of the first diameter portion of the drawbar;

a collet having a first bore and a second bore, the first bore being adapted to receive a chuck jaw assembly for grippingly engaging fasteners, the second bore being adapted to receive the second diameter portion of the drawbar, the collet being slidably disposed within the anvil; and the drawbar having a section of the first diameter portion disposed within the first aperture, a front section of the second diameter portion threadedly engaged within the second bore of the collet, a rearward section of the second diameter portion passing through the second aperture of the anvil thereby providing a bearing surface between the rearward section of the second diameter portion and the second aperture of the anvil, and the third diameter portion passing through the second aperture of the anvil.

13. The apparatus of claim 12, wherein the front section of the second diameter portion of the drawbar includes left-hand threads.

14. The apparatus of claim 12, wherein the threads disposed at the rearward end of the drawbar are right-hand threads.

15. The apparatus of claim 12, wherein the chuck jaw assembly is a unitized chuck jaw assembly.

16. The apparatus of claim 12, wherein the first diameter portion of the drawbar includes an internal hexagonal recess at the front end of the drawbar for receiving a hexagonal key.

17. The apparatus of claim 12, further comprising threads disposed at a rearward end of the first bore, and a deflector attached to a nut that is threadedly engaged with the rearward end of the first bore.

18. The apparatus of claim 12, wherein the end of the piston of the fastener installation tool is a chamfer of a preselected angle.

19. The apparatus of claim 12, wherein the end of the piston of the fastener installation tool is a shoulder.

20. An apparatus for installing fasteners comprising:

a drawbar having a first portion, a second portion, a third portion, and threads disposed at a rearward end of the drawbar;

an anvil having a cavity, a first aperture, and a second aperture, the first aperture being adapted to receive a portion of the drawbar;

a collet having a first bore and a second bore, the first bore being adapted to receive a chuck jaw assembly for grippingly engaging fasteners and having threads disposed at a rearward end of the first bore, the second bore being adapted to receive the second portion of the drawbar, the collet being slidably disposed within the anvil; and the first portion of the drawbar disposed within the first aperture, a front section of the second portion of the drawbar threadedly engaged within the second bore of the collet, a rearward section of the second portion of the drawbar passing through the second aperture of the anvil thereby providing a bearing surface between the rearward section of the second portion and the second aperture of the anvil, and the third portion of the drawbar passing through the second aperture of the anvil; and a deflector attached to a nut that is threadedly engaged with the rearward end of the first bore.

* * * * *